United States Patent [19]

Arbter

[11] Patent Number: 4,660,486

[45] Date of Patent: Apr. 28, 1987

[54] DEVICE FOR FORMING A DOUBLY TURNED HEM

[75] Inventor: Conrad Arbter, Saal/Saale, Fed. Rep. of Germany

[73] Assignee: Pfaff Industriemaschinen GmbH, Fed. Rep. of Germany

[21] Appl. No.: 828,768

[22] Filed: Feb. 12, 1986

[30] Foreign Application Priority Data

Feb. 15, 1985 [DE] Fed. Rep. of Germany ..... 3505170

[51] Int. Cl.[4] ..... D05B 35/04

[52] U.S. Cl. ..... 112/143; 112/304

[58] Field of Search ..... 112/141, 304, 121.15, 112/143, 217, 423

[56] References Cited

U.S. PATENT DOCUMENTS

| | | | |
|---|---|---|---|
| 1,631,956 | 6/1927 | De Voe | 112/141 |
| 2,004,080 | 6/1935 | Roby | 112/121.15 |
| 2,173,509 | 9/1939 | Swanson | 112/141 |
| 2,279,588 | 4/1942 | Enos | 112/141 |
| 2,355,766 | 8/1944 | Westhoff | 112/141 |
| 3,481,292 | 12/1969 | Danahy | 112/141 X |
| 3,906,877 | 9/1975 | Rockerath et al. | 112/141 |

*Primary Examiner*—Werner H. Schroeder
*Assistant Examiner*—Andrew M. Falik
*Attorney, Agent, or Firm*—McGlew and Tuttle

[57] ABSTRACT

A device for forming a doubly turned hem on lengths of fabric with a folding sleeve, in the inner space of which a flexible sheet is provided as auxiliary folding device, which presses the fabric against the guiding surface of the folding sleeve and, as the start of fabric is pushed through the folding sleeve, constantly follows its cross-sectional shape. The effective area of the auxiliary folding device can have a fur-like surface, the pile of which is aligned in the direction of advance of the material to be sewn. In order to open a gap for the unimpeded introduction of the edge of the fabric, a shaped metal plate, by means of which the auxiliary folding device is coiled, is movable between the guiding surface of the folding sleeve and the auxiliary folding device.

9 Claims, 8 Drawing Figures

DEVICE FOR FORMING A DOUBLY TURNED HEM

FIELD AND BACKGROUND OF THE INVENTION

This invention relates in general to sewing devices and in particular to a new and useful device for facilitating the formation of a doubly turned hem on lengths of material.

In the hem folding device, known from U.S. Pat. No. 2,004,080, the material to be sewn is led past the stitch forming site of a sewing machine by several conveyor belts, arranged next to one another, and by an external hem folding belt. A hem folding sleeve with a U-shaped inlet region and a doubly twisted outlet region for forming a doubly turned hem are arranged along the external hem folding belt. The formation of the hem is supported by the driven hem folding belt on the whole length of the hem folding sleeve in the sense that, for the formation of the first 180° turn, the hem folding belt runs under the edge to be turned in the hem folding sleeve and, for the formation of the second 180° turn, it follows the shape producing hem formation and finally embraces the finished hem in a U-shaped fashion in the region of the outlet.

By these means, the transfer of tensile stress to the workpiece while the machine is working is said to be avoided and the material is guided into and through the folding sleeve. The hem formation is, however, supported directly by the hem folding belt only for the fabrication of the second 180° turn, while the first 180° turn is formed exclusively by loading the fabric past the appropriately bent guiding surfaces of the folding sleeve, so that, in this case, there is an initial compression, which has a decisive effect on the magnitude of the hem distortion. Especially for materials with a rough or adhering surface, this distortion at the start of the hem cannot be avoided. This effect is particularly noticeable with workpieces, the inlet edge of which is already formed into a doubly turned hem. In the region of the hemmed inlet edge, nine layers of materials lie over one another at the side edge of these workpieces after the hem is formed. These form a bulge. Considerable frictional resistance must be overcome to pass this bulge through the outlet of the hem folding sleeve, because the region of the outlet of the hem folding sleeve, which gives the hem its final state, must be matched not to the bulge, but to the thickness of the material.

When using the hem folding belt of the device of U.S. Pat. No. 2,004,080, the thickness of the hem folding belt must be taken into consideration in addition to the thickness of the material. This, however, is then responsible for the fact that the side edge of the workpiece is not turned accurately and guided reliably over the whole of its length. In any case, the bulges are distorted or contorted as they are pushed through the outlet of the hem folding sleeve. The folded parts of the hem do not then lie flush with the inlet edge of the workpiece and considerably impairs the appearance of the workpiece.

SUMMARY OF THE INVENTION

The invention insures achieving accurate hem formation and guidance and the avoidence of the compression of the inlet edge of the workpiece as it is passed through the outlet of the hem folding sleeve.

The doubly turned edge region of the workpiece can be introduced into the folding sleeve without any frictional resistance by means of the auxiliary folding device, the cross section of which can be reduced. The workpiece is forced by the relaxing of the auxiliary folding device against the shape giving inner guiding surface of the following sleeve and is pushed forward with the inlet edge through the outlet of the folding sleeve as far as under the pressure foot in the working region of the transporting implement of the sewing machine. By these means, not only is the hem formed accurately, but the pushing action of the auxiliary folding device also counteracts the compressive effect and, with that, distortion of the start of the hem is reliably avoided even when an already cross hemmed inlet edge is pushed through.

Accordingly, it is an object of the invention to provide an improved device for facilitating the formation of a double turned hem and which includes the spirally extending and longitudinally extending converging sleeve having a longitudinally extending workpiece entrance at one side and having a converging end which is adapted to be oriented in front of a movable thread guiding needle operable in a stitch forming area. Means are provided for feeding a workpiece material longitudinally and through the entrance of the sleeve toward the converging end thereof. The sleeve on its interior defines a deflecting surface for deflecting the material into a double turn. In accordance with the invention, an auxiliary folding device is arranged within the sleeve and includes a flexible portion which is movable within the sleeve and urges the workpiece to move around the deflecting surface in the interior of the sleeve so as to form a double turn of the material.

Accordingly, it is an object of the invention to provide an improved device for forming a material into a double turn and so that it can be eventually presented to a needle at a stitch forming area.

A further object of the invention is to provide a sewing device which affects the formation of a material being fed to a reciprocating needle to a double turned hem so that the hem may be immediately sewn.

A further object of the invention is to provide a sewing device and a device for facilitating the formation of material prior to sewing which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2, 3, 4, 5, 6, 7, 8:
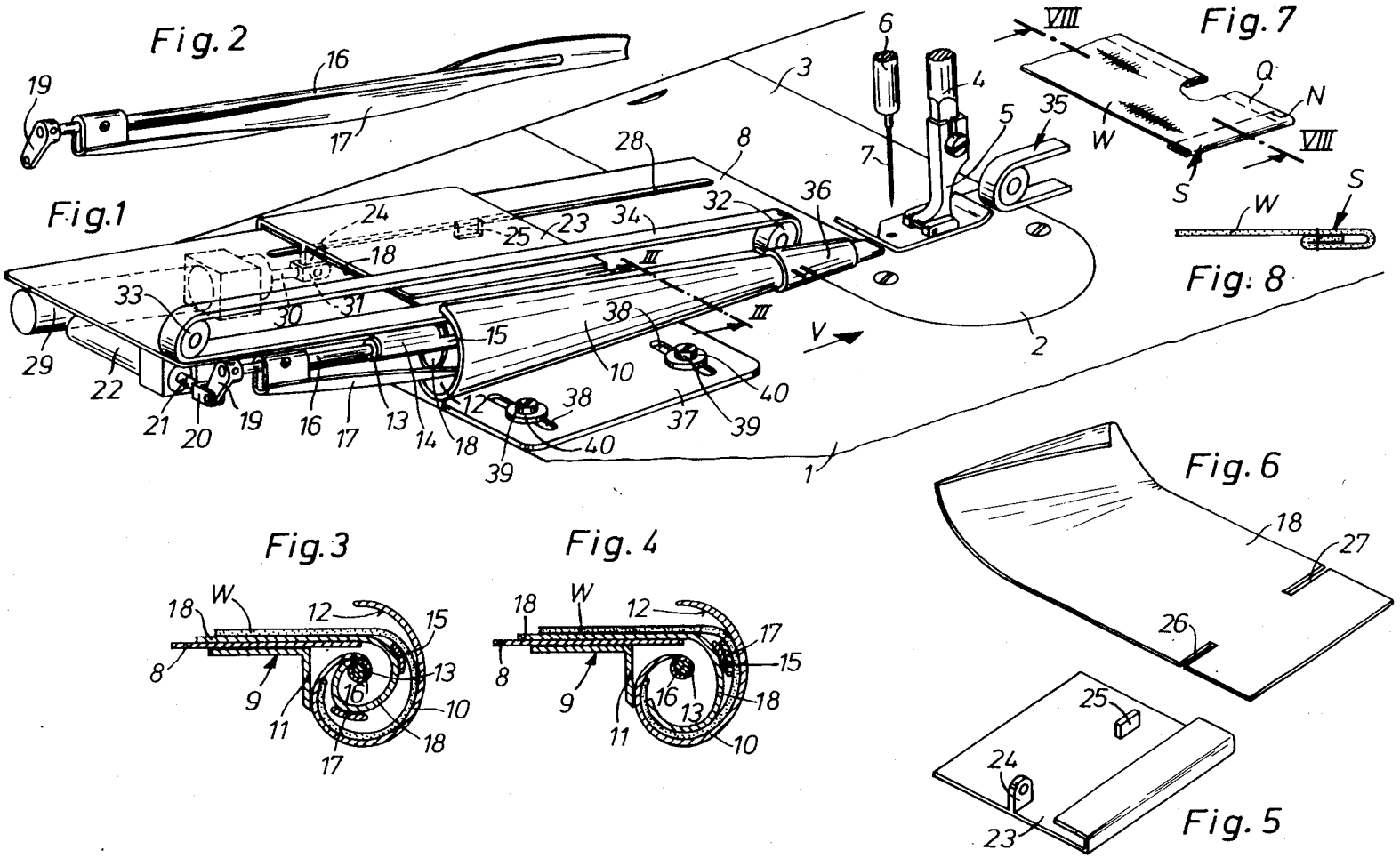
FIG. 1 is a diagrammatic perspective view of a device constructed in accordance with the invention and arranged ahead of the stitch forming area on the fabric supporting plate of a sewing machine.
FIG. 2 is a perspective view of a shaped metal sheet for an auxiliary folding device used with the invention.
FIG. 3 is a section along the line III—III of FIG. 1 on a larger scale, with the auxiliary folding device coiled into a position of constricted cross section by the shaped metal sheet.
FIG. 4 shows a representation, similar to that of FIG. 3, with the auxiliary folding device in the operating position and the shaped metal sheet in the starting position.
FIGS. 5 and 6 show top perspective views of the support for the auxiliary folding device and the auxiliary folding device in diagrammatic representation.
FIG. 7 is a perspective top view of a portion of the hemmed workpiece that has left the sewing machine.
FIG. 8 is a section along the line VIII—VIII of FIG. 7.

Referring to the drawings in particular the invention embodied therein comprises a double turn hem forming device for use with a sewing machine which has a movable thread guiding needle 7 which is operable in the stitch forming area formed on a needle plate 2. In accordance with the invention, a spirally extending and longitudinally converging sleeve 10 has a longitudinally extending workpiece entrance on one side and has its converging end oriented toward the stitch area of the sewing machine. Means are provided for feeding a workpiece material which in the embodiment illustrated comprises a movable conveyor 34. The workpiece material is fed longitudinally and through the side entrance of the sleeve 10 toward the converging end of the sleeve. In accordance with a feature of the invention the sleeve 10 defines a deflection surface within its interior for effecting a double fold of the material as it is advanced therethrough. The particular feature of the invention is that an auxiliary folding device 18 is arranged within the sleeve 10 and it includes a flexible portion movable within the sleeve for urging the workpiece to move around the deflecting surface 12 on the interior of the sleeve.

The hem forming device is intended to be used in conjunction with a sewing machine including a base supporting plate 1 with a needle plate 2 and cover plate 3, as well as a pressure foot 5 attached to a pressure bar 4 and a needle bar 6 with a thread carrying needle 7 shown in the drawing. The needle 7 works together with a shuttle, which is not shown and is arranged under the needle plate 2, to form the hem.

The device has a fabric support plate 8, to the underside of which a supporting elbow 9 for a hem folding sleeve 10 is soldered. The sleeve 10 is firmly connected by soldering with the vertical leg 11 of the supporting elbow 9. From its inlet side to its outlet, the hem folding sleeve 10 is conical in shape and has a curved inner guiding surface 12 for folding the edge region of a workpiece W twice by 180° to a doubly turned hem S, shown in FIGS. 7 and 8.

In the interior of the folding sleeve 10, a bearing sleeve 13 is provided, which extends parallel to the longitudinal axis of the folding sleeve 10 and is borne by a support 14 attached to the underside of the fabric support plate 8. The support 14 has a curved elongation 15 extending in the longitudinal direction of the folding sleeve 10. A shaped metal sheet 17, which is individually shown in FIG. 2 and which is rigidly connected at one end to a bearing shaft 16, is rotatably contained in the bearing sleeve 13 and, together with the bearing shaft 16, can be pushed into the bearing sleeve 13. The shaped metal sheet 17 can be rotated about the bearing shaft 16 between the inner guiding surface of the folding sleeve 10 and an auxiliary folding device 18, which is shown individually in FIG. 6 and which, because of its inherent elasticity is prestressed elastically against the guiding surface 12, between a working position shown in FIG. 4 and a position shown in FIG. 3, in which a gap, adequate for the unimpeded introduction of the edge region of a workpiece W between the guiding surface 12 and the auxiliary folding device 18 is opened up owing to the fact that the auxiliary folding device 18 is coiled over the whole of its length to a reduced cross section by twisting the shaped metal sheet 17.

The auxiliary folding device 18 may be a thin, flexible sheet of spring steel or a plastic sheet with good recovery capabilities.

The auxiliary folding constructions are intended to be used for processing already cross hemmed workpieces. Their front edge takes hold of the front cross hem Q of the workpiece being pushed through. For processing workpieces with an unhemmed lead-in edge, it is advantageous if the auxiliary folding device 18 has a fur-like structure, perhaps a velour coating, the pile of which is lying in the direction in which the workpiece is being supplied (arrow V). By these means, the individual hairs or fibers straighten up against the workpiece and carry it along as the auxiliary folding device 18 is shifted into the advance direction, arrow V, while they lie flat as the auxiliary folding device 18 is withdrawn, so that it can be moved back without hindrance, to its starting position.

For the purpose of turning the shaped metal sheet 17, a lever 19 which is connected over a forkhead 20 with the piston rod 21 of a pneumatic cylinder 22 mounted on the underside of the fabric support plate 8, is connected to one end of the bearing shaft 16.

The auxiliary folding device 18 can be coupled with a plate slide 23, one end of which is flat, and a U-shaped end which has two driving bars 24 and 25, which engage slots 26 and 27 in the auxiliary folding device 18, together with the plate slide 23, is mounted on the fabric support plate 8 in such a manner, that the free edge of the auxiliary folding device, as can be seen especially in FIG. 4, protrudes next to the inner side of the elongation 15 of the support 14 into the inner space of the folding sleeve 19. Also the U-shaped, curved end of the plate slide 23 embraces one side edge of the fabric support plate 8 and the driving bars 24, 25, protruding through the slots 26, 27 in the auxiliary folding device 18, are guided in a guide slot 28 in the fabric support plate 8.

The auxiliary folding device 18, together with the slide 23, can be moved parallel to the direction of advance of the material to be sewn, arrow V, by means of a pneumatic cylinder 29 arranged below the fabric support plate 8. For this purpose, the forkhead 31, mounted on the piston rod 30 of the pneumatic cylinder 29, is connected with the driving bar 24 of the slide 23.

For the purpose of transporting the material to be sewn to the stitch forming site, a conveyor belt 34 is provided, which is shown in a simplified fashion and is guided over guide pulleys 32, 33, and which can be raised for the purpose of introducing a workpiece. A further conveyor belt 35 for carrying away the sewn material is arranged behind the stitch forming site.

When using a spring steel auxiliary folding device, it is advantageous to provide a magnet arrangement 36 in the region of the outlet of the folding sleeve 10. By means of this magnet arrangement 36, the auxiliary folding device 18 is pulled against the inner guiding surface 12 of the folding sleeve 10.

The folding device is rigidly connected with a mounting plate 37, which is mounted on the fabric support plate 1 of the sewing machine with two screws 39 passing through longitudinal slots 38 with insertion of washers 40.

Before the introduction of the side edge of a workpiece W into the hem folding sleeve 10, the pneumatic cylinder 22 is acted upon with compressed air. As a result, the shaped metal sheet 17 is twisted by the piston rod 21, the forkhead 20 and the lever 19 mounted on the bearing shaft 16 about the bearing shaft 16 from the position shown in FIG. 4 into the position shown in FIG. 3. At the same time, auxiliary folding device 18 is coiled inwards, so that a gap, sufficiently wide for the unimpeded introduction of the edge of the workpiece W, is opened between the guiding surface 12 of hem folding sleeve 10 and the auxiliary folding device 18. With conveyor belt 34 raised, the edge region of the workpiece W is then introduced into the opened gap in the folding sleeve 10, the transversely hemmed lead-in edge Q being advanced up to the front edge of the auxiliary folding device 18. Thereupon, the pneumatic cylinder 22 is vented and the shaped metal plate 17 is moved back into its original position, shown in FIG. 4, by the action of a restoring spring that is arranged in the cylinder housing. At the same time, the tension of the auxiliary feeding device 18 is relieved, causing the edge region of the workpiece W to be pressed against the guiding surface 12 of the hem folding sleeve 10.

The pneumatic cylinder 29 is now acted upon by compressed air, as a result of which the slide 23, together with the auxiliary folding device 18 is pushed forward to the sewing machine by the piston rod 30, which is connected with working piston and the forkhead 31, which is mounted on the piston rod 30, the front edge of the auxiliary folding device 18 engaging the transverse hem Q and advancing the lead-in edge of workpiece W to a position below the raised pressure foot 5. Since the edge region of the workpiece, which is to be folded over twice, is kept in close contact with the guiding surface 12 by the auxiliary folding device 18, which is prestressed elastically against the guiding surface 12, and the front edge of the auxiliary folding device 18 engages the transverse hem Q at the lead-in edge of the workpiece W, not only is the hem formation supported by the auxiliary folding device 18, which adapts to the shaping guiding surface 12 during the advance, but a distortion of the start of the hem, as it is being pushed through the outlet of the folding sleeve 10, is also actively counteracted.

The hem forming action of the auxiliary folding device 18 is improved by the magnet arrangement 36 in the region of the outlet of the hem folding device 10, owing to the fact that the auxiliary folding device 18 and, with that, the workpiece are pulled more strongly against the inner guiding surface 12 by the magnetic force.

When the front edge of the workpiece W has been advanced to the sewing position below the raised pressure foot 5, then the latter and the conveyor belt 34 are lowered, the auxiliary folding device 18 is moved back to its starting position by appropriately controlling the compressed air to the pneumatic cylinder 29 and the sewing machine, as well as the conveyor belts 34 and 35, are switched on. As it passes through the folding sleeve 10, the side edge of the workpiece is turned twice by 180°, sewn by a hem N (FIGS. 7, 8) and transported by the conveyor belt 35 behind the stitch-forming site to a stacking position. After a workpiece W has passed and the sewing machine is stopped, the pressure foot 5 and the conveyor belt 34 are raised, the auxiliary folding device 18 is coiled by twisting the shaped metal sheet 17 about the bearing shaft 16, and, with that a gap is opened up for introducing the edge of a workpiece. A new workpiece can then be introduced into the folding sleeve and the process described can take place once again.

While specific embodiments of the invention have been shown and described in detail to illustrate the application of the principles of the invention, it will be understood that the invention may be embodied otherwise without departing from such principles.

What is claimed:

1. A hem folding device for forming a double hem in a double turned edge of a workpiece for use with a sewing machine having a movable thread guiding needle operable in a stitch forming area, comprising a spirally extending and longitudinally converging sleeve having a longitudinally extending workpiece entrance at its one end and having a converging end oriented toward the stitch forming area, means for feeding a workpiece material longitudinally and through said entrance toward the converging end of said sleeve, said sleeve defining a deflecting surface on its interior for deflecting the workpiece material into a double hem, and an auxiliary folding device within said sleeve including a flexible portion which is movable parallel to the direction of advance of the material to be sewn within said sleeve and which follows the cross-sectional shape of the workpiece in order to press the edge region of the workpiece against said deflecting surface.

2. A hem folding device for forming a double hem in a double hem in a double turned edge of a workpiece for use with a sewing machine having a movable thread guiding needle operable in a stitch forming area, comprising a spirally extending and longitudinally converging sleeve having a longitudinally extending workpiece entrance at its one side and having a converging end oriented toward the stitch forming area, means for feeding a workpiece material longitudinally and through said entrance toward the converging end of said sleeve, said sleeve defining a deflecting surface on its interior for deflecting the workpiece material into a double hem, and an auxiliary folding device within said sleeve including a flexible portion movable within said sleeve and urging the workpiece to move around said deflecting surface, said auxiliary folding device being movable parallel to the direction of advance of the material to be sewn within said sleeve and which follows the cross-sectional shape of the workpiece in order to press the edge region of the workpiece against said deflecting surface.

3. A device according to claim 2, including a shaped metal sheet rotatably arranged at the interior of said folding sleeve between said deflecting surface of the interior of said sleeve and said auxiliary folding device for the purpose of opening a lead-in gap for the edge of the workpiece.

4. A device according to claim 2, including an actuating drive connected to said auxiliary folding device.

5. A device according to claim 4, wherein said metal sheet is connected to said actuating drive.

6. A device according to claim 2, wherein said auxiliary folding device comprises a thin spring steel sheet which can be coiled.

7. A device according to claim 2, wherein said auxiliary folding device comprises a plastic sheet which can be coiled and including a rigid slide movably mounted adjacent said sleeve and carrying said plastic sheet.

8. A device according to claim 2, wherein said auxiliary folding device has a pile surface which is aligned in the direction of advance of the material to be sewn.

9. A device according to claim 2, including a magnet arranged at the exterior of said sleeve in the area of said converging end.

* * * * *